US005786319A

United States Patent [19]

Pedersen et al.

[11] Patent Number: 5,786,319

[45] Date of Patent: Jul. 28, 1998

[54] CONCENTRATED AQUEOUS DEGREASING CLEANSER

[75] Inventors: Kimberly M. Pedersen, Canton; Paul A. Pappalardo, Northville, both of Mich.

[73] Assignee: Diversey Lever, Inc., Plymouth, Mich.

[21] Appl. No.: 880,776

[22] Filed: Jun. 23, 1997

Related U.S. Application Data

[63] Continuation of Ser. No. 503,805, Jul. 18, 1995, abandoned.

[51] Int. Cl.[6] ..... C11D 1/88; C11D 1/72; C11D 3/20; C11D 3/43

[52] U.S. Cl. ..... 510/423; 510/234; 510/218; 510/365; 510/422; 510/424; 510/433; 510/413; 510/421; 510/427; 510/432

[58] Field of Search ..... 510/423, 234, 510/218, 365, 422, 424, 433, 413, 421, 427, 432

[56] References Cited

U.S. PATENT DOCUMENTS

| | | | |
|---|---|---|---|
| 3,591,510 | 7/1971 | Zenk | 525/153 X |
| 3,644,210 | 2/1972 | Crotty et al. | 252/548 |
| 3,702,825 | 11/1972 | von der Eltz et al. | 252/171 X |
| 3,882,038 | 5/1975 | Clayton et al. | 252/153 X |
| 3,888,798 | 6/1975 | Hansen | 252/545 |
| 3,960,742 | 6/1976 | Leonard | 252/153 X |
| 4,157,921 | 6/1979 | Baturay et al. | 134/40 X |
| 4,284,533 | 8/1981 | Imamura et al. | 252/173 X |
| 4,287,080 | 9/1981 | Siklosi | 252/104 |
| 4,309,300 | 1/1982 | Danforth et al. | 252/170 |
| 4,372,788 | 2/1983 | Lancz | 134/40 X |
| 4,375,422 | 3/1983 | Blackstone | 252/546 X |
| 4,416,792 | 11/1983 | Blackstone | 252/173 X |
| 4,528,039 | 7/1985 | Rubin et al. | 134/40 X |
| 4,557,853 | 12/1985 | Collins | 252/128 |
| 4,592,787 | 6/1986 | Johnson | 252/153 X |
| 4,686,065 | 8/1987 | Bliznik et al. | 252/170 X |
| 4,753,750 | 6/1988 | Ouhadi et al. | 252/DIG. 14 |
| 4,808,235 | 2/1989 | Woodson et al. | 252/153 X |
| 4,919,839 | 4/1990 | Durbut et al. | 252/153 |
| 4,921,629 | 5/1990 | Malihi et al. | 252/171 X |
| 4,931,063 | 6/1990 | Wilsberg et al. | 252/DIG. 14 |
| 4,943,392 | 7/1990 | Hastedt et al. | 252/171 X |
| 4,966,724 | 10/1990 | Culshaw et al. | 252/171 X |
| 4,971,722 | 11/1990 | Philippsen | 252/73 X |
| 4,983,317 | 1/1991 | Requejo et al. | 252/DIG. 14 |
| 5,035,826 | 7/1991 | Durbut et al. | 252/173 X |
| 5,061,393 | 10/1991 | Linares et al. | 252/173 X |
| 5,075,026 | 12/1991 | Loth et al. | 252/171 X |
| 5,076,954 | 12/1991 | Loth et al. | 252/171 X |
| 5,080,822 | 1/1992 | Van Eenam | 252/171 X |
| 5,080,831 | 1/1992 | Van Eenam | 252/173 X |
| 5,139,772 | 8/1992 | Morita et al. | 424/70 |
| 5,158,710 | 10/1992 | VanEenam | 252/171 X |
| 5,292,828 | 3/1994 | Jenkins et al. | 525/420 |
| 5,342,450 | 8/1994 | Cockrell, Jr. et al. | 134/40 X |
| 5,342,549 | 8/1994 | Michael | 252/153 X |
| 5,362,422 | 11/1994 | Masters | 252/170 X |
| 5,364,551 | 11/1994 | Lentsch et al. | 252/156 |
| 5,376,298 | 12/1994 | Michael | 252/153 |
| 5,397,495 | 3/1995 | Winston et al. | 252/173 X |
| 5,415,812 | 5/1995 | Durbut et al. | 252/171 X |
| 5,415,813 | 5/1995 | Misselyn et al. | 252/153 X |
| 5,419,848 | 5/1995 | Van Eenam | 252/162 X |
| 5,429,684 | 7/1995 | Osberghaus et al. | 252/171 X |
| 5,435,935 | 7/1995 | Kupneski | 252/156 |
| 5,437,807 | 8/1995 | Garabedian, Jr. et al. | 252/153 |
| 5,461,100 | 10/1995 | Jenkins et al. | 252/70 X |
| 5,714,453 | 2/1998 | Neumiller | 510/405 |

FOREIGN PATENT DOCUMENTS

| | | |
|---|---|---|
| 0232530 | 8/1987 | European Pat. Off. . |
| 0299691 | 10/1993 | European Pat. Off. . |
| 2702775 | 3/1993 | France . |
| 6100894 | 1/1994 | Japan . |
| 2134132 | 1/1983 | United Kingdom . |
| 9406265 | 3/1994 | WIPO . |
| 9507974 | 3/1995 | WIPO . |

OTHER PUBLICATIONS

Dowanol Glycol Ethers brochure from The Dow Chemical Company, 27 pages (May 91).

The Glycol Ethers Handbook, pp. 52–54 (date unknown).

Alkali Surfactant NM Data Sheet from Tomah Products, Inc., rev. Aug. 24, 1994.

*Primary Examiner*—Douglas J. McGinty

*Attorney, Agent, or Firm*—A. Kate Huffman

[57] ABSTRACT

A concentrated detergent formulation effective to remove grease includes a glycol ether solvent system in combination with a high concentration of a surfactant system stably dispersed in water. The surfactant system is preferably a combination of an hydrotrope and a nonionic surfactant with a concentration preferably in the range of 7% or greater. The glycol ether solvent system can be any of a number of glycol ethers with dipropylene glycol n-butyl ether and dipropylene glycol monomethyl ether preferred. The formulation can be used at high concentrations to effectively remove baked-on grease in deep fryers and clean parking lots and can be used at a lower concentration as a presoak and even at a more dilute concentration for general purpose degreasing and spray and wipe cleaner. The product is low alkaline and non-corrosive.

11 Claims, No Drawings

CONCENTRATED AQUEOUS DEGREASING CLEANSER

This application is a file wrapper continuation of application Ser. No. 08/503,805 filed on Jul. 18, 1995, now abandoned.

BACKGROUND OF THE INVENTION

For institutional applications such as restaurants and cafeterias, it is desirable to provide a water based detergent composition which provides a wide range of cleaning abilities. This provides an all-in-one cleaning composition by simply changing dilution rates. In order to serve as such a detergent, the detergent must of course effectively remove a variety of different soils. A detergent used in a restaurant must be able to remove grease. One of the more severe applications is cleaning cooked-on grease and oil. Deep fryers accumulate a large amount of caked-on or cooked-on grease which must be periodically removed.

There are many different cleaning compositions that can remove such baked-on grease but they have many negative side effects. Many such cleaning compositions are highly alkaline or acidic. Therefore, they corrode metal and are not desirable for an all purpose cleaner. It is preferable to use such detergents which are not corrosive to most metals, particularly aluminum and other soft metals.

Compositions used to remove grease also frequently employ very volatile solvents. These are undesirable because of their high VOC. It is preferable for a detergent to have a low VOC and preferably a relatively high flash point to avoid any possibility of a fire. For a number of reasons, including safety, cost and flexibility, the preferred detergent should be an aqueous based detergent.

SUMMARY OF THE INVENTION

The present invention is premised on the realization that a concentrated multi-purpose cleaning composition can be formulated by combining glycol ether type solvents with a high concentration of a surfactant system dissolved in water and stabilized with a hydrotrope. More particularly, the present invention is premised on the realization that a cleaning composition from lower alkyl ethers of propylene glycol, and dipropylene glycol, in combination with preferably a nonionic surfactant system and a stabilizing agent such as an amphoteric surfactant or an anionic surfactant hydrotrope can be used in concentrated form to clean baked-on grease from deep fryers and can be used as a diluted cleaner for pre-soak treatment, general degreasing applications, and even parking lot cleaning.

In a preferred embodiment, the solvent system is a combination of dipropylene glycol monomethylether and dipropylene glycol n-butyl ether in combination with an alcohol ethoxylate and an amphoteric surfactant such as an iminodipropionate. This can be combined with crystal growth inhibitors such as polyacrylates, alkaline agents such as carbonates and hydroxides and corrosion inhibitors such as silicates. This composition is sufficiently stable to provide 30% actives concentration and 10% surfactant or higher and is particularly useful as a fryer boiling out agent. The objects and advantages of the present invention will be further appreciated in light of the following detailed description.

DETAILED DESCRIPTION

The cleaning composition of the present invention is an aqueous based cleaning composition which includes a solvent system and a surfactant system dissolved or disbursed in water and stabilized with a hydrotrope. The solvent system is a low VOC, high flash point solvent system which is formed from one or more glycol ethers. There are a wide variety of glycol ethers which can be used, including propylene glycol methyl ether, dipropylene glycol methyl ether, tripropylene glycol methyl ether, propylene glycol methyl ether acetate, dipropylene glycol methyl ether acetate, propylene glycol n-butyl ether, dipropylene glycol n-butyl ether, propylene glycol n-propyl ether, dipropylene glycol n-propyl ether, tripropylene glycol n-butyl ether, ethylene glycol n-butyl ether, diethylene glycol n-butyl ether, trimethylene glycol n-butyl and higher homologs, diethylene glycol methyl ether, trimethylene glycol methyl ether and higher homologs, as well as combinations of these.

Preferred ethers include dipropylene glycol n-butyl ether, dipropylene glycol monomethyl ether, tripropylene glycol methyl ether and propylene glycol methyl ether.

These can be used alone or in combination. Generally the more water soluble ethers assist in achieving a higher concentration and stability for the less water soluble ethers. Generally, the concentration of the organic solvent system will be from about 3–30% by weight on an actives basis and generally from about 5–15%. The detergent formulation also includes a surfactant system. The total concentration of the surfactant system should be at least 7% and preferably 10–12% or higher, stabilized in solution. Generally, the surfactant system can include a wide variety of surfactants including nonionic surfactants, anionic surfactants and amphoteric surfactants, and, less preferably, cationic surfactants. The anionic and amphoteric surfactants act both to increase the surfactant concentration and to provide stabilization for the other components, i.e., acting as hydrotropes.

The nonionic surfactant suitable for use in the present invention can include alkalene oxide adducts of polyhydric components, alkyl aryl ethoxylates, alcohol ethoxylates and mixtures thereof. Among the more useful nonionic surfactants typifying the alkalene oxide adducts of polyhydric components are the ethylene oxide adducts of ethylene diamine sold commercially under the name Tetronic, as well as the ethylene oxide propylene oxide adducts of propylene glycol commercially sold under the name Pluronic.

Representative of the alkyl aryl ethoxylates are for example the ethoxylated alkylphenols. The alkyl substituant in such compounds may be derived from polymerized propylene, diisobutylene, octene or nonene. Examples of compounds of this type include nonylphenol condensed with 2 to 9 moles of ethylene oxide per mole of nonylphenol and dodecylphenol condensed with up to 10 moles of ethylene oxide per mole of phenol, and octylphenols condensed with 5–12 ethylene oxide molecules per mole of phenol. Commercially available nonionic surfactants of this type include Tergitol NP-9 sold by Union Carbide, Igepal CO-530 marketed by the GAF Corporation and Triton X-45 and X-114 marketed by Union Carbide.

The alcohol ethoxylates include the condensation products of aliphatic alcohols with ethylene oxide. The alkyl chain of the aliphatic alcohol may either be straight or branched and generally contains 8–22 carbon atoms. Examples of commercially available nonionic surfactants of this type include Genupol UD 079 (a branched chain alcohol ethoxylate with 3–7 EO groups and a $C_{11}$), Tergitol 15S3. Linear primary alcohol ethoxylates are particularly useful in the present invention. Such linear primary alcohol ethoxylates can have an alcohol chain of from $C_6$–$C_{13}$ with 2.5 to 9 ethylene oxide groups per molecule. One preferred nonionic is Neodol 91-6 which has a $C_9$–$C_{11}$ primary alcohol chain with approximately 6 ethylene oxide groups per molecule.

The goal of the present invention is of course to have from about 7 to about 15% by weight or more surfactant in the detergent composition. Generally, the present invention will include from about 3% to about 12% nonionic depending on the particular hydrotrope, the solvent blend and level, and total electrolyte level. In a preferred embodiment, the nonionic will be about 3–8% of the concentrated detergent.

The surfactant system can also include an anionic surfactant. These are a well known group of surfactants. The anionic surfactant is preferably a strong hydrotrope. Such anionics include carboxylated fatty alcohol ethoxylates sold under the name Neodox, the lower alkyl and aryl sulfonates and sulfates such as ethyl hexyl sulfate, xylene sulfonate, cumene sulfonate, naphthalene sulfonate, sodium dodecyl diphenyloxide disulfonate and sodium n-decyl diphenyloxide disulfonate, and the sarcosinates such as sodium lauryl sarcosinate.

Other commercially important anionics are the linear alkyl sulfonate salts such as sodium or potassium lauryl sulfonate and sodium and potassium alkyl benzene sulfonate and the sodium and potassium salts of $C_8$–$C_{18}$ fatty acids. The anionic surfactants of the present invention can range from 0–10% and preferably from 0–5%.

The amphoteric surfactants used in the present invention are preferably hydrotropes which maintain the nonionic and glycol ether solvents in solution and increase the overall surfactant concentration and detergent performance. A wide range of amphoteric surfactants can be employed and will vary depending on the desired alkalinity of the detergent composition. Many of the important amphoterics include the alkyl imidazolines, such as the Monoterics™ sold by Mona, as well as the quaternary ammonium carboxylates as well as the alkyl and alkyl alkoxy iminodipropionates, such as lauryl iminodipropionate and isodecyloxypropyl iminodipropionate, also referred to as Alkali Surfactant NM sold by Tomah Products, Inc. These are generally available in aqueous solution and they should be added to the detergent composition in an amount effective to maintain the stability of the concentrated detergent solution. The amount will vary, depending on whether an anionic surfactant hydrotrope is employed. Generally, the amphoteric will be present in an amount of about 0–15% (actives) of the detergent composition with about 3–10% being preferred.

Of course, in the present invention, it is preferred to have at least one hydrotrope present, either the anionic surfactant based hydrotropes or the amphoteric surfactant based hydrotropes, and generally there will be at least about 3% of such a hydrotrope in the detergent composition.

In addition to the amphoterics, anionics and nonionics, the present invention can also include cationics. However, these are generally less preferred.

The detergent formulation can include several optional components. One such component is an aluminum protecting agent such as the alkali metal salts of the silicates, including sodium and potassium polysilicates, metasilicates, and the hydrates thereof which can be added in an amount from about 0 to about 1 % by weight.

Further, alkaline agents can also be added. Suitable alkaline agents include carbonates such as sodium or potassium carbonate, and hydroxide such as sodium and potassium hydroxide. These can be added from about 0 to about 15%, depending upon the desired pH.

Generally, it is preferred in the present invention to maintain the pH less than 13.5 or 13 and preferably less than 12. However, moderate alkalinity aids in the stabilization of the detergent composition and improves end use performance. In the preferred embodiment of the present invention, the pH will be maintained from 9–11.8.

The detergent composition can also include a polycarboxylate to prevent scale by crystal growth inhibition. Generally, this will be present in an amount from about 0 to about 4% with about 0.5–1.5% preferred.

The present invention can also include various chelants and sequestrants such as phosphates, phosphonates, ethylene diamine tetracetic acid salts, nitrilioacetic acid salts, derivatives of phosphonic acid such as imino trimethylene phosphonic acid or 1-hydroxyethylidine-1 diphosphonic acid, sold under the trademarks such as Dequest 2000 and Dequest 2010, respectively, and the like. However, these do not substantially add to the present invention. Therefore, these are not included within the preferred formulation of the present invention. The composition can also include fragrances and dyes as desired.

The order of addition is not absolutely critical for practicing the present invention. However, due to solubility, the carbonates and metasilicates are generally added first, followed by the hydrotrope, either the amphoteric or anionic surfactant, followed by the solvent and polyacrylate and any remaining components. The invention will be further appreciated in light of the following example which employ the formulations listed in Table 1.

TABLE 1

| Formula # (Active %) | 1 | 2 | 3 | 4 | 5 | 6 | 7 | 8 | 9 | 10 |
|---|---|---|---|---|---|---|---|---|---|---|
| Lauryl iminodiopropionate (35%) Active | 15% | | | | | | | | | |
| Alkali Surfactant NM (30%) | | 15 | 15 | 15 | 15 | | 15 | 15 | | |
| Neodox 23-6 (100%) | | | | | | | | | | 7 |
| Genapol UD 079 (100%) | 5 | 5 | 5 | | | 5 | | | | |
| Igepal CO 630 (100%) | | | | 5 | | | | | | |
| Neodol 91-6 (100%) | | | | | 5 | | 5 | 5 | 5 | 5 |
| Neodox 25-11 (100%) | | | | | | | 7 | | | |
| Acusol/445N (50%) | | | | | 1 | 1 | 1 | 1 | 1 | 1 |
| Dowanol DPnB (100%) | 5 | 5 | 5 | 5 | 5 | 5 | 5 | 5 | 5 | 5 |
| Dowanol DPM (100%) | 5 | 5 | 5 | 5 | 5 | 5 | 5 | 5 | 5 | 5 |
| Dequest 2000 | | | | | | | 1.125 | | | 1.22 |
| Dequest 2010 | | | | | | | 0.375 | | | 0.375 |
| Potassium Carbonate (100%) | 8 | 8 | 10 | 10 | 10 | 10 | | | | |

TABLE 1-continued

| Formula # (Active %) | 1 | 2 | 3 | 4 | 5 | 6 | 7 | 8 | 9 | 10 |
|---|---|---|---|---|---|---|---|---|---|---|
| Sodium Silicate (36%) | | | | | | | 0.5 | | | 0.5 |
| KOH (45%) | 1 | 2 | | | | | 2.91 | 1.5 | | 4.06 |
| Monoethanolamine | | | | | | | | | 10 | |
| Sodium metasilicate pentahydrate | .9 | .9 | | | .25 | .25 | | .25 | .25 | |
| Water softened | 60.1 | 59.1 | 60 | 60 | 58.75 | 58.75 | 72.09 | 67.25 | 58.75 | 70.94 |
| pH | 13.56 | 13.6 | 11.1 | 11.1 | 11.2 | 11.2 | 10.8 | 12.6 | 11.4 | 11.9 |

The active components listed in the formulations in Table 1 were simply combined with water, as previously described, and mixed. These formulations were then tested to determine their efficacy in removing vegetable oil baked onto low carbon stainless steel. This is comparable to the cleaning of a deep fryer. In order to test this, vegetable oil was simply brushed on 316 low carbon stainless steel strips and baked for 15 minutes and cooled. These were then soaked in a diluted solution (one part detergent to nine parts water) heated to 85°–100° C. for up to 15 minutes, rinsed in tap water, and air dried. During this time, all of the detergent formulations began to act on the baked-on vegetable oil. Formulations listed as 5, 6, 7, 8 and 9 performed as well or better than a commercially available degreaser.

The detergents listed in Formulas 5 and 8 were then tested and compared with a commercially available "non-corrosive" deep fryer cleaner to determine their effect on aluminum. Specifically an aluminum 7075 T6 coupon was tested according to ASTM Method G31 to determine weight loss. This was repeated twice.

Formula 5 demonstrated a weight loss of 0.0005 gm in both tests. Formula 8 caused a weight loss of 0.0007 and 0.0010 gm, respectively in the two tests, whereas the commercially available "non-corrosive" fryer degreaser showed a weight loss of 0.0398 gm in the first run and 0.0922 gm in the second run.

The present invention can be used in a variety of different manners. When diluted with 1–15 parts water per part detergent, the present invention can be used to clean deep fryers by filling the deep fryer with the cleaning solution heated to 50°–100° C. for five minutes to an hour. This will effectively dissolve the baked-on soil. It can be diluted, for example, with 0–1 part water by weight and used to clean parking lots. Further, this can be diluted with 1 to 3 parts of water to one part detergent and used as a pre-soak to clean pizza racks, pots and pans the like, by simply soaking them in the diluted solution for a period of about ten minutes to twelve hours. The detergent can be diluted with 4–30 parts water and used as a general purpose degreaser. If the detergent formulation is provided at a lower pH, it can be further diluted with, for example, 30–100 parts water to provide a glass cleaner and a light duty spray and wipe cleaner.

Thus the present invention, due to its high concentration of surfactant, can be used as an all-in-one cleaning composition which is particularly designed to remove oil and grease. Even grease such as that baked onto deep fryers can be easily removed. Further, the detergent formulation which has a relatively low pH is easy to transport, requiring no special transportation labeling. Further, of course, this reduces damage to the surface being cleaned.

This, of course, has been a description of the present invention along with the best mode of practicing the invention currently known. However, the invention itself shall only be defined by the appended claims wherein

We claim:

1. A liquid detergent composition comprising 3–30% by weight of a glycol ether solvent system effective to dissolve vegetable grease and a surfactant system comprising a combination of a nonionic surfactant and a hydrotrope wherein said glycol ether solvent system and said surfactant system are stably dispersed in water at a pH less than 13;

wherein said surfactant system comprises at least about 3% nonionic surfactant by weight, and an amount of an iminodiproprionate amphoteric surfactant effective to stabilize said nonionic surfactant in solution, wherein said nonionic surfactant and the amphoteric surfactant form at least 7% of the composition; and wherein said solvent system is selected from the group consisting of propylene glycol methyl ether, dipropylene glycol methyl ether, tripropylene glycol methyl ether, propylene glycol methyl ether acetate, dipropylene glycol methyl ether acetate, propylene glycol n-butyl ether, dipropylene glycol n-butyl ether, tripropylene glycol n-butyl ether, ethylene glycol n-butyl ether, diethylene glycol n-butyl ether, triethylene glycol n-butyl ether, diethethylene glycol methyl ether, triethylene glycol methyl ether, and combinations thereof.

2. The composition claimed in claim 1 comprising from about 3 to about 10% amphoteric surfactant.

3. The composition claimed in claim 1 wherein said solvent system comprises 5–15% of said composition.

4. The composition claimed in claim 3 wherein said solvent system is selected from the group consisting of propylene glycol methyl ether, dipropylene glycol n-butyl ether, tripropylene glycol methyl ether and dipropylene glycol monomethyl ether, and combinations thereof.

5. The composition claimed in claim 4 wherein said solvent system is a combination of dipropylene glycol n-butyl ether and dipropylene glycol monomethyl ether.

6. The composition claimed in claim 3 further comprising a silicate selected from the group consisting of alkali metal salts of polysilicates, metasilicates, and hydrates thereof.

7. The composition claimed in claim 3 further comprising an amount of a water soluble polycarboxylate in an amount effective to inhibit crystal growth.

8. The composition claimed in claim 1 wherein said nonionic surfactant is an alcohol ethoxylate.

9. The composition claimed in claim 8 wherein said nonionic is a linear alcohol ethoxylate having at least about 2.5–9 ethylene oxide groups per molecule.

10. The composition claimed in claim 1 wherein said composition contains no chelants or sequestering agents.

11. The composition claimed in claim 1 having a pH of from about 9–11.8.

* * * * *